United States Patent [19]

Tarc

[11] 4,369,975

[45] Jan. 25, 1983

[54] DISPLAY TILE FOR ELECTRONIC CHESS GAME

[76] Inventor: Andrew Tarc, 590 Raglan St., P.O. Box 448, Palmerston, Ontario, Canada, N0G 2P0

[21] Appl. No.: 145,366

[22] Filed: Apr. 30, 1980

[30] Foreign Application Priority Data

Jan. 28, 1980 [CA] Canada ..... 344533

[51] Int. Cl.[3] ..... A63F 3/02

[52] U.S. Cl. ..... 273/237

[58] Field of Search ..... 273/237, 238, 85 G, 273/288, 1 E; 434/128, 129; 340/753, 723 R; 364/410

[56] References Cited

U.S. PATENT DOCUMENTS

| | | | |
|---|---|---|---|
| 3,525,091 | 8/1970 | Lally | 340/753 |
| 3,608,904 | 9/1971 | Margetson | 273/288 |
| 3,654,392 | 4/1972 | Beinhocker | 273/237 |
| 3,843,132 | 10/1974 | Ferguson | 273/238 |
| 3,888,491 | 6/1975 | Bernard | 273/237 |
| 3,893,671 | 7/1975 | Gardner | 273/238 |
| 3,923,306 | 12/1975 | Cahn-Hidalgo | 434/128 |
| 4,019,745 | 4/1977 | Mustelier | 273/237 |
| 4,073,067 | 2/1978 | Beach | 273/237 |
| 4,082,285 | 4/1978 | Bathurst | 273/237 |
| 4,114,890 | 9/1978 | Yamamoto et al. | 273/237 |
| 4,244,635 | 1/1981 | Sasaki et al. | 273/237 |

FOREIGN PATENT DOCUMENTS

| | | | |
|---|---|---|---|
| 2229202 | 12/1974 | France | 273/288 |
| 544215 | of 1956 | Italy | 273/238 |
| 1488654 | 10/1977 | United Kingdom | 273/237 |

OTHER PUBLICATIONS

*Popular Mechanics;* Aug. 1976; p. 71.

Pealler, T.; "Character Generator Glowlamp;" *IBM Technical Disclosure Bulletin;* Aug. 1958; p. 6.

*Electronics;* "Chessmate;" Mar. 4, 1976, p. 44.

*Primary Examiner*—Vance Y. Hum

*Attorney, Agent, or Firm*—Laff, Whitesel, Conte & Saret

[57] ABSTRACT

A display tile for use in a chess game matrix has optical display segments which may be actuated to simultaneously display chess men and the allowed direction of movement of the chess men during the game of chess.

3 Claims, 12 Drawing Figures

DISPLAY TILE FOR ELECTRONIC CHESS GAME

This invention relates generally to games of the type having a matrix of display tiles that may be electrically actuated from a digital memory and, in particular, relates to a display tile for use in such matrix.

Games actuated electrically from a digital memory have now become increasingly popular, in particular, the game of chess wherein the chessmen may be portrayed by symbols on a chess board matrix, there being a keyboard for each game player which may be actuated by the player to display chess moves on the matrix. Games of this nature are exemplified in U.S. Pat. No. 4,019,745 issued Apr. 26, 1977 as well as U.S. Pat. No. 3,888,491 issued June 10, 1975. Such patents illustrate a chess board matrix of tiles adapted to optically display chess men of different colours in the game of chess with a keyboard and digital memory which is arranged to store memory as dictated by operation of the keyboard and to display information in the form of moves in the game of chess on the chess board matrix.

One of the problems associated with the game of chess is that the various game pieces can move only in different prescribed directions and distances and the complicated movements can be difficult to master.

The present invention therefore provides a display tile for use in a chess game matrix of the type described wherein the tile not only displays a symbol for the various chess men used in the game of chess but at the same time, indicates the allowed direction of movement of the individual chess pieces during the chess game.

One aspect of the invention therefore comprises, a display tile for use in the game of chess, such tile having a plurality of optical display elements adapted to be selectively actuated to optically display symbols representing at least the six types of chess men of each of two colours, the symbols when displayed indicating the allowed directions of movement of the chess men in the game of chess.

In drawings illustrating the invention,

FIG. 1 is a schematic illustration of a display tile illustrating the arrangement of the display elements and electrical connections thereto.

FIG. 2*a* is an illustration of a tile with display elements actuated to indicate a black pawn.

FIG. 2*b* illustrates the tile with display elements actuated to indicate a white pawn.

Figure 1:
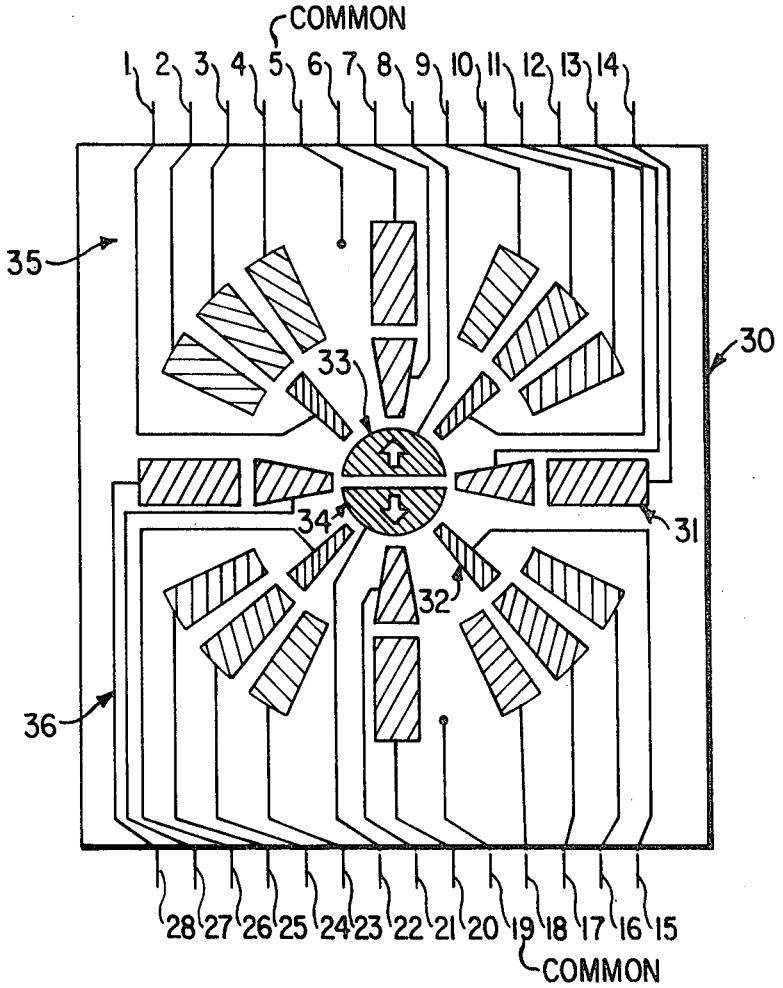

The display tiles as used in the matrix will be described with reference to FIG. 1 in the drawings. The tiles in the matrix are identical and are constructed of square translucent material as indicated generally at 30. The material has embedded therein a plurality of segments preferably LCD's, positioned to form an outer ring indicated generally at 31, an inner ring indicated generally at 32 and central half-moon segments indicated generally at 33 and 34. The individual liquid crystal display segments in the outer ring 31, the inner ring 32 and the half-moon central portions 33 and 34 are each connected by suitable wiring or printed circuits indicated generally at 35 and 36, to opposite edges of the tile. The connections to the individual LCD segments are conveniently numbered 1 through 28 in FIG. 1 in the drawings so that a description of the selection of individual segments to form symbols representing the chess men of different colours of movement of the chess men will be readily understood.

Figure 2A:
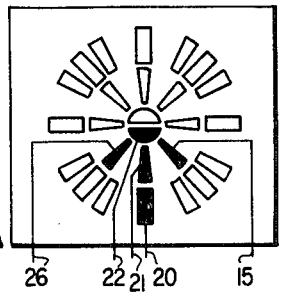
Figure 2B:
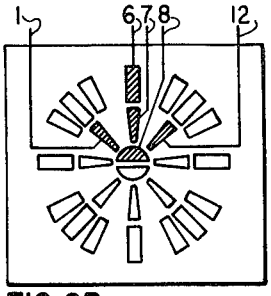

As is known, in the game of chess the pawn can only be moved straight ahead or diagonally and this movement of the pawn is illustrated in FIGS. 2*a* and 2*b* in the drawings. As will be seen in FIG. 2*a* a black pawn is illustrated on the display tile by applying power to connections 26, 22, 21, 20 and 15. Illustration of a white pawn is accomplished by powering connections 1, 6, 7, 8 and 12. The designation of the pawn as either a black pawn or a white pawn is accomplished by actuating either of the half-moon segments designated generally as 33 and 34 and illuminated by powering connectors 8 or 22.

Figure 3:
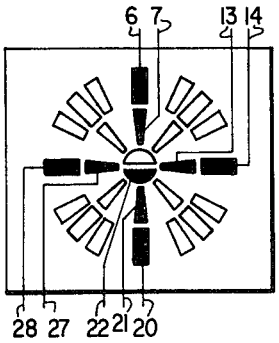
FIG. 3 illustrates the display elements actuated to indicate a black rook.

The rook or castle can of course move on a straight line either forward, backward or to either side, the rook display being indicated in FIG. 3 of the drawings. FIG. 3 illustrates the display for a black rook wherein connectors 6 and 7, 13 and 14, 20 and 21 and 27 and 28 are powered together with connection 22. To designate a white rook the same segments are illuminated with the exception connection 22 is not powered but rather, power is applied at connection 8 to illuminate segment 33.

Figure 4:
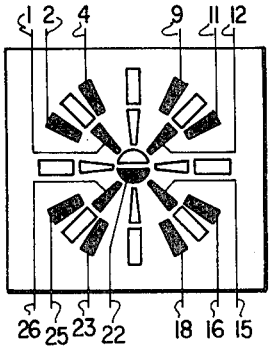
FIG. 4 illustrates the display elements actuated to indicate a black knight.
Figure 5:
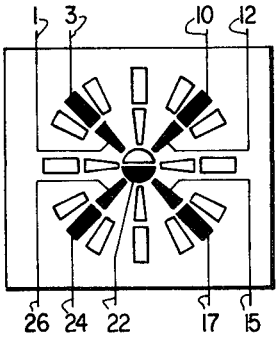
FIG. 5 illustrates the display elements actuated to indicate a black bishop.

The knight may move either forwardly, backwardly or laterally to a square adjoining the occupied square and then move diagonally and reference to FIG. 4 of the drawings will clearly illustrate the display for a black knight indicating such movement. Here connections 1, 2, 4, 9, 11, 12, 15, 16, 18, 22, 23, 25, 26 are powered and of course power applied to connection 22 will illuminate segment 34 to desginate a black knight. To designate a white knight the same segments are illuminated but power is applied through connection 8 to illuminate segment 33, segment 34 not being illuminated The bishop may of course move diagonally on the chess board and reference to FIG. 5 will illustrate the symbol in this case. Connections 1 and 3, 10 and 12, 15 and 17 and 24 and 26 are powered as is connection 22 to indicate a black bishop. As was the case previously to indicate a white bishop connection 34 is not powered but rather connection 8 is to illuminate segment 33 instead of 34.

Figure 6:
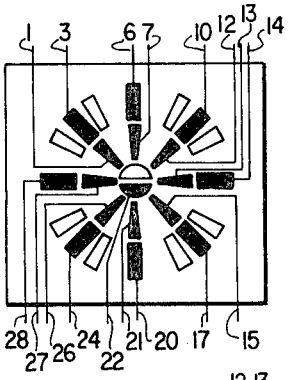
FIG. 6 illustrates the display elements actuated to indicate a black queen.

Movement of the queen may be either vertically, horizontally or diagonally is illustrated by the symbol displayed in FIG. 6. Here connections 1 and 3, 6 and 7, 10 and 12, 13 and 14, 15 and 17, 20 and 21 and 24 and 26 are powered as is connection 22 to illuminate segment 34 and indicate a black queen, again, to indicate a white queen segment 34 is extinguished and segment 33 is illuminated by applying power to connection 8.

Figure 7:
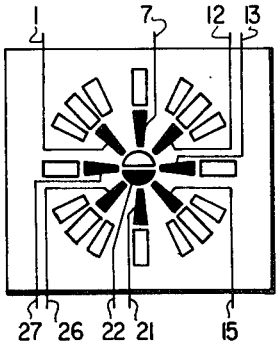
FIG. 7 illustrates the display elements actuated to indicate a black king.

Movement of the king may be vertically, horizontally or diagonally although of restricted scope as compared to the queen. Here, the symbol of FIG. 7 is displayed where connections 1, 7, 12, 13, 15, 21, 26 and 27 are powered as is connection 22 to indicate a black king. As previously described, to indicate a white king, segment 34 is extinguished and segment 33 illuminated by powering connection 8.

Figure 8:
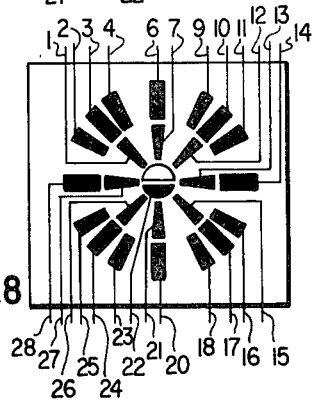
FIG. 8 illustrates the display elements actuated to show a black test pattern.

To provide a test pattern for both the black and white chess men, the symbol of FIG. 8 is displayed. This symbol utilizes all of the individual segments of the tile there being either of the segments 34 or 33 illuminated to indicate a black or white test pattern.

It will now clearly be seen there is provided a display tile whose segments may be selectively illuminated to indicate all of the chess men in either of the two colours with the symbols for the chess men clearly indicating the allowed directions of movement of the chess men on a chess board.

So that black and white chess men will be readily distinguishable, colours such as blue to indicate black chess men and yellow to indicate white chess men may be utilized or, any other suitable colours employed as desired.

Figure 9:
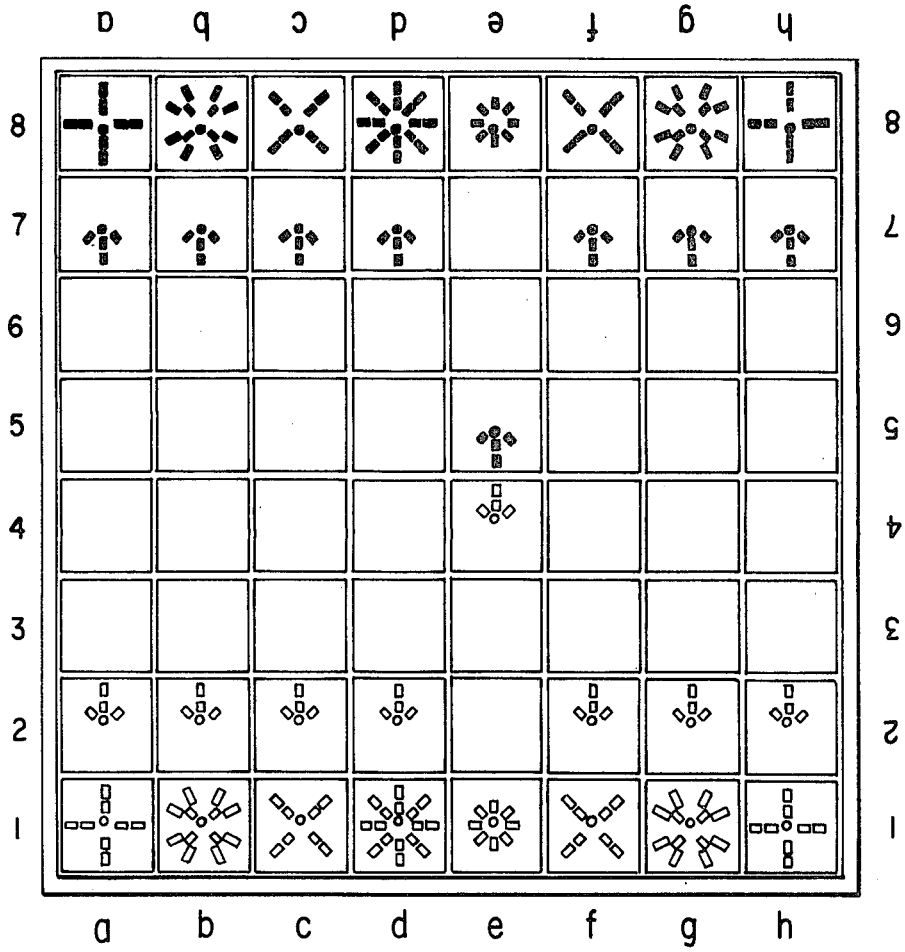
FIG. 9 is a top plan view of a matrix for use in a chess game all of the game pieces being illustrated with two of the pawns having been moved.

Reference now to FIG. 9 of the drawings will show a preferred form of a matrix formed of 64 tiles set up in the usual ranks numbered 1 to 8 and files lettered a to h in chess board configuration. The matrix indicates the various symbols designating the chess men in position on the chess board and indicates a black and white pawn moved on the board. The black pawn has moved to position 5*e* the white pawn to position 4*e*.

Figure 10:
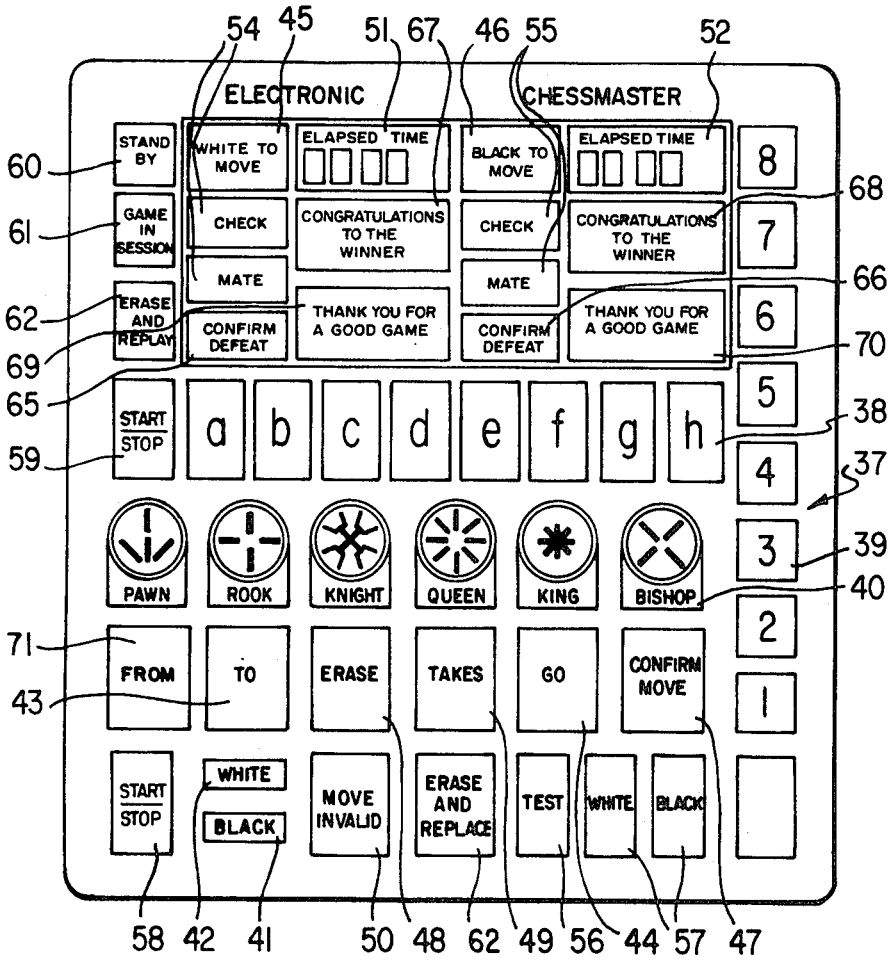
FIG. 10 is an illustration of a preferred form of keyboard for use with the invention.
Figure 11:
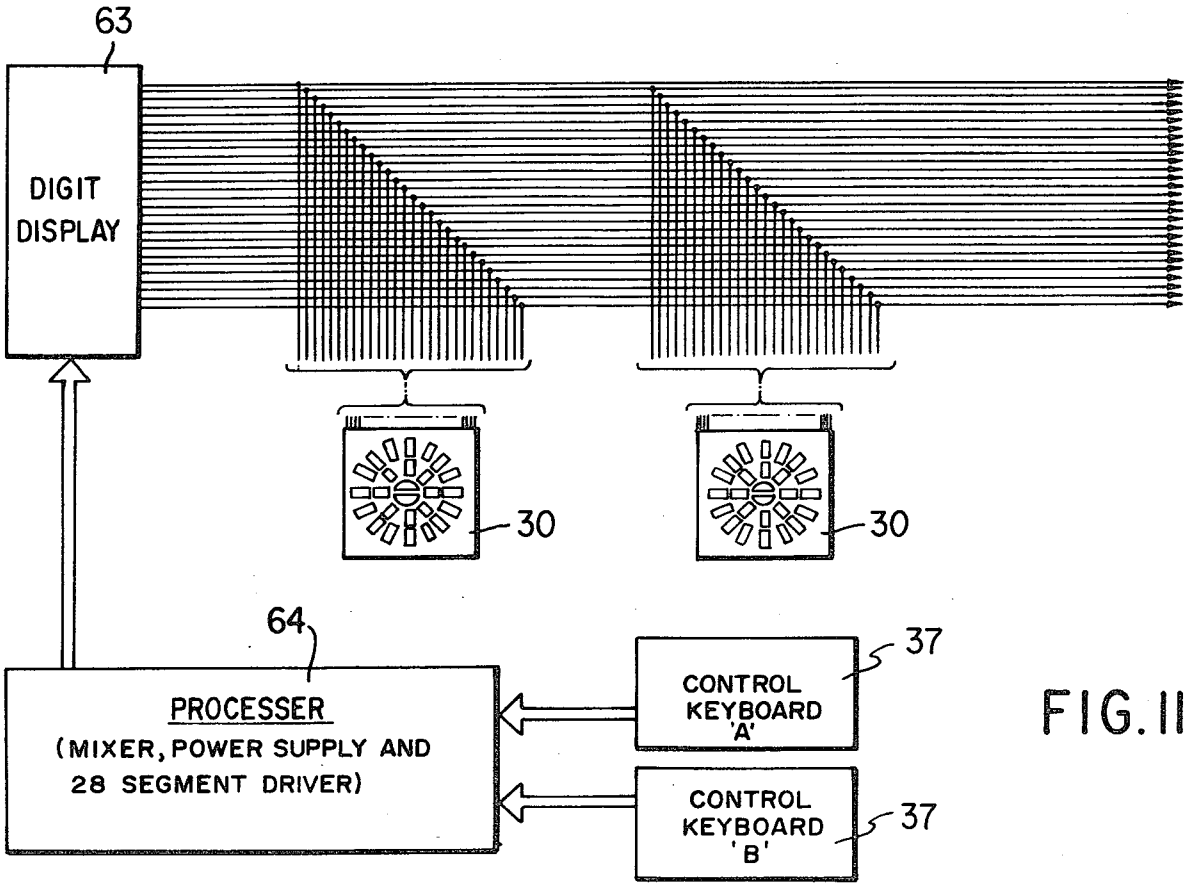
FIG. 11 illustrates a schematic electrical diagram to interconnect the keyboard, processor, displays and display elements.

The keyboard control unit designated generally at 37 and illustrated in FIG. 10 includes a series of file keys 38 lettered a through h and a series of rank keys 39 numbered 1 through 8 to correspond to the matrix of FIG. 9. Symbol keys 40 for the 6 chess men are located below the file keys 38 while colour keys 41 and 42 indicating either white or black chess men are located in the lower left hand corner of the board adjacent the start/stop or on/off function switch 58. A second start/stop switch 59 is located immediately to the left of the file keys 38.

Control and actuation of the LCD segments on the display tiles is accomplished through a digital display mechanism 63 connected to the 28 connectors of each tile and in turn driven by micro processor 64 which is controlled by one or more control keyboards 37.

A typical sequence in a game of chess would then be as follows:

(1) press both upper and lower start/stop buttons 58 and 59 to illuminate standby light 60 in the upper left hand corner of the keyboard.

(2) press either white or black buttons 41 or 42 to establish player colour. When the black button 41 is pressed, the "white to move" button 45 will light on opponent's board and elapsed timer 51 will begin.

(3) a typical move might then be shown as follows (white to play) to move a white pawn "e2" to "e4". The "FROM" button 71 is pressed, followed by the letter "e" etc—in file keys 38, then number "2" in rank keys 39. The pawn designation on symbol keys 40 is then pressed and thereafter the "TO" button 43 is pressed followed by letter "e" in file keys 35, number "4" in the rank keys 39, and then the "GO" button 44. At this point the complete move is displayed on the "white to move" indicator 45 and, if the player wishes the move, the confirm button 47 is then pressed. The move will be indicated on both display board matrixes and will also light the "black to move" button 46 and elapsed timer 52.

If, after pressing "GO" button 44, the player changes his mind, the move may be erased by pressing button 48 and the move replayed, however, if the "confirm" button 47 has been pressed no erasure can be made.

(4) in a typical operation to take an opponent's chess piece the sequence is essentially the same with the exception that the "takes" button 49 is depressed.

"Check" and "checkmate functions" 54 and 55 are both a key and light function.

Further refinements may be wired into the keyboard such as "confirm defeat" buttons 65 and 66 which would automatically light up, "congratulatory" buttons 67 and 68 and if desired, "thank you" buttons 69 and 70 could be included.

Should a player be aware of an incorrect move by his opponent, the "move invalid" button 50 would be depressed which would light up the buttons on his own and opponent's display and at the same time the "erase and replay" button 62 on the opponent's board would light and the opponent's timer would also be activated. This would permit opponent to press the "erase" button 48 and return both display boards to the previous sequence so that a valid move could then be made.

Testing of the display tiles by lighting all of the LCD segments in all tiles, is accomplished by pressing the "test" button and either "white or black" or both "white and black" buttons 56 and 57.

It will of course be obvious that the symbols as displayed in two dimensions on my display tiles could be used to form three dimensional chess pieces which could be used to play a conventional manual game of chess on a standard chess board. Such use of three dimensional pieces in this symbol form would aid a player in understanding the symbols and electronic chess board as described herein.

The embodiments of the invention in which an exclusive property or privilege is claimed are defined as follows:

1. An electronic board game comprising:

A. a plurality of display tiles arranged in a chessboard pattern, each of said tiles being a square of translucent material having means for enabling simulated movement of game symbols across said board during game play;

B. a plurality of separate display segment means positioned under said square of translucent material, said display segment means being liquid crystal display elements and being arranged in a generally radial pattern of discontinuous liquid crystal display elements disposed in a concentric circular array of ring configurations, each successive inner ring being comprised of fewer display elements than the preceding ring;

C. said means for enabling a simulated movement including means for selectively enabling individual display of a selected one of many sub-patterns, said selected enabling means including a keyboard having individual keys for selectively including one of at least six different game symbols, the color of said game symbols, the direction of allowed game playing movements and the playing position;

D. said means for simulated movement further including display control means comprising a matrix of wires extending from said liquid crystal display elements to the keys of said keyboard, operation of each of said keys energizing a corresponding combination of wires in said matrix to cause the associated segment to be displayed in said sub-patterns; and E. microprocessor means having memory means interposed between said keyboard and said matrix of wires for storing in memory the movement and position of the game symbols.

2. The electronic board game of claim 1 wherein said selection enabling means includes at least two keyboards, one for each player.

3. The electronic game board of claim 2 wherein said two keyboards are at a location which is remote from said board game.

* * * * *